US005853131A

United States Patent [19]

Cheng

[11] Patent Number: 5,853,131

[45] Date of Patent: Dec. 29, 1998

[54] DESKTOP PAPER SHREDDER

[76] Inventor: Li-Feng Cheng, No. 75, Hsiou-Shui, Hsiou-Shui Li, Hou-Lung Chen, Miao-Li Hsien, Taiwan

[21] Appl. No.: 966,528

[22] Filed: Nov. 10, 1997

[51] Int. Cl.[6] ..... B02C 4/08

[52] U.S. Cl. ..... 241/100; 241/167; 241/236

[58] Field of Search ..... 241/100, 167, 241/236, 291

[56] References Cited

U.S. PATENT DOCUMENTS

| | | | |
|---|---|---|---|
| 4,018,392 | 4/1977 | Wagner | 241/167 |
| 4,637,560 | 1/1987 | Goldhammer | 241/100 |
| 4,717,085 | 1/1988 | Crane | 241/236 |
| 4,944,462 | 7/1990 | Raterman et al. | 241/100 |
| 4,981,270 | 1/1991 | Reber | 241/166 |
| 5,163,629 | 11/1992 | Raterman et al. | 241/236 |
| 5,269,473 | 12/1993 | Strohmeyer et al. | 241/100 |

*Primary Examiner*—John M. Husar

*Attorney, Agent, or Firm*—Beveridge, DeGrandi, Weilacher & Young, LLP

[57] ABSTRACT

A desktop paper shredder including a housing in which a pair of shafts are rotationally mounted. The housing is provided with an entrance that corresponds to and is aligned with the shafts. A paper trash container is removably disposed at the lower portion of the housing. The shafts are driven by a driving device and meshed with each other such that their rotations are opposite to each other. Each shaft is further provided with a spiral groove in which a plurality of sets of shredding blades are disposed therein. Each of the sets of shredding blades is spaced from the next set of shredding blades by a spacing collar on which is provided a paper trash stopper. The external end portion of each paper trash stopper is fixedly attached to the configuring tab within the housing. The perimeter of each shredding blade is further provided with a plurality of knives. Each shredding blade is further provided with a projecting tab that rests in a selected spiral groove. Accordingly, the knives of the shredding blades are spirally arranged along the shaft. The shredding blades alternatively intersect with each other to effectively shred an inserted paper sheet as the shafts are rotated in opposite directions to each other.

9 Claims, 4 Drawing Sheets

DESKTOP PAPER SHREDDER

FIELD OF THE INVENTION

The present invention relates to a paper shredder, more particularly, to a desktop paper shredder in which a plurality of knifes arranged spirally are provided to shred an inserted paper sheet into elongate strips.

DESCRIPTION OF PRIOR ART

Normally, the confidential information will be destroyed after it is expired. Besides, the wanted but not hope to be revealed information will be also destroyed. This information or paper sheets are always destroyed through the paper shredder.

However, the existing paper shredder has a bulky size and it is intended for considerable paper sheets and it is intended for one or two paper sheets.

The shredding knifes mounted on the existing paper shredder include a pair of shafts that are provided with a plurality of ring cutters along their length. Each of the ring cutters is alternatively intersected and even a little bit overlaps with each other. By this arrangement, when the paper sheet is passed through the rotating shafts, the paper sheet can be smoothly cut into a plurality of elongate strips. However, those elongate strips have a relative larger volume and it is not suitable for storing. This will cause trouble to the user.

SUMMARY OF THE INVENTION

It is the objective of this invention to provide a desktop paper shredder that is suitable for a small quantity of shredding.

It is still the objective of this invention to provide a desk paper shredder in which the paper sheet is cut into small pieces to reduce the overall volume.

In order to achieve the objective set forth, a desktop paper shredder includes a housing in which a pair of shafts is rotationally mounted therein. The housing is provided with an entrance that is corresponding and aligned to those shafts. A paper trash container is removably disposed at the lower portion of the housing. The shafts are driven by a driving device and meshed with each other such that their rotations are opposite to each other. The shaft is further provided with a spiral groove in which a plurality of sets of shredding blades is disposed therein. Each of the sets of shredding blades is spaced with each other by means of a spacing collar and which is provided with a paper trash stopper. The external end portion of the paper trash stopper is fixedly attached to the configuring tab within the housing. The perimeter of the shredding blade is further provided with a plurality of knifes. The shredding blade is further provided with a projecting tab that rests in the spiral groove. Accordingly, the knife of the shredding blade is spirally arranged along the shaft. The knifes of the shredding blade are also alternatively intersected with each other, and the inserted paper sheet can be effectively shredded by those shredding blade as the shafts are rotated opposite to each other.

According to another aspect of the present invention, the desktop paper shredder is suitable for cutting small quantity of paper sheets. The knife is arranged spirally and the inserted paper sheet can be cut into small pieces to reduce the overall volume.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
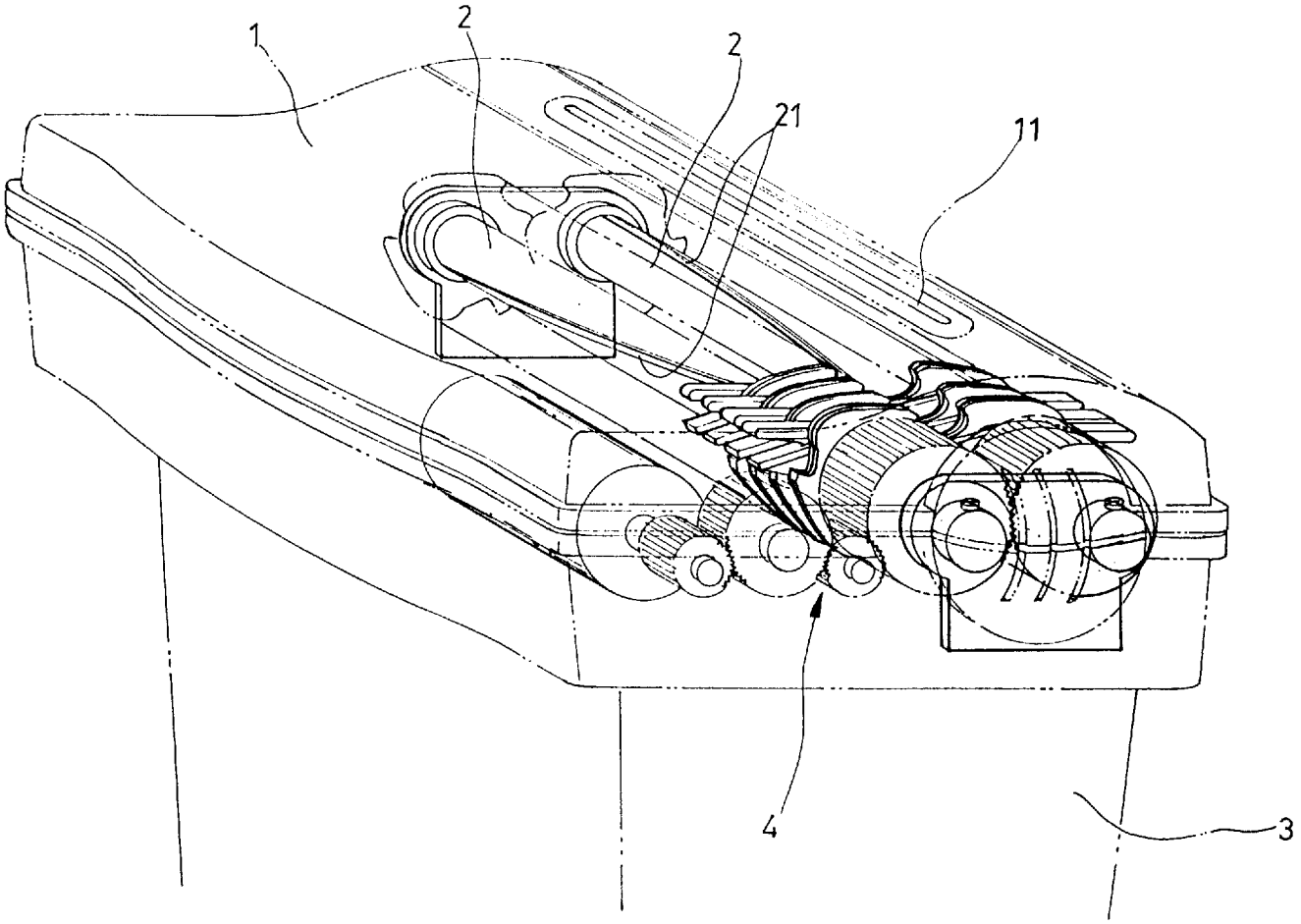
FIG. 1 is a perspective view of the desktop paper shredder made according to the present invention.
Figure 2:
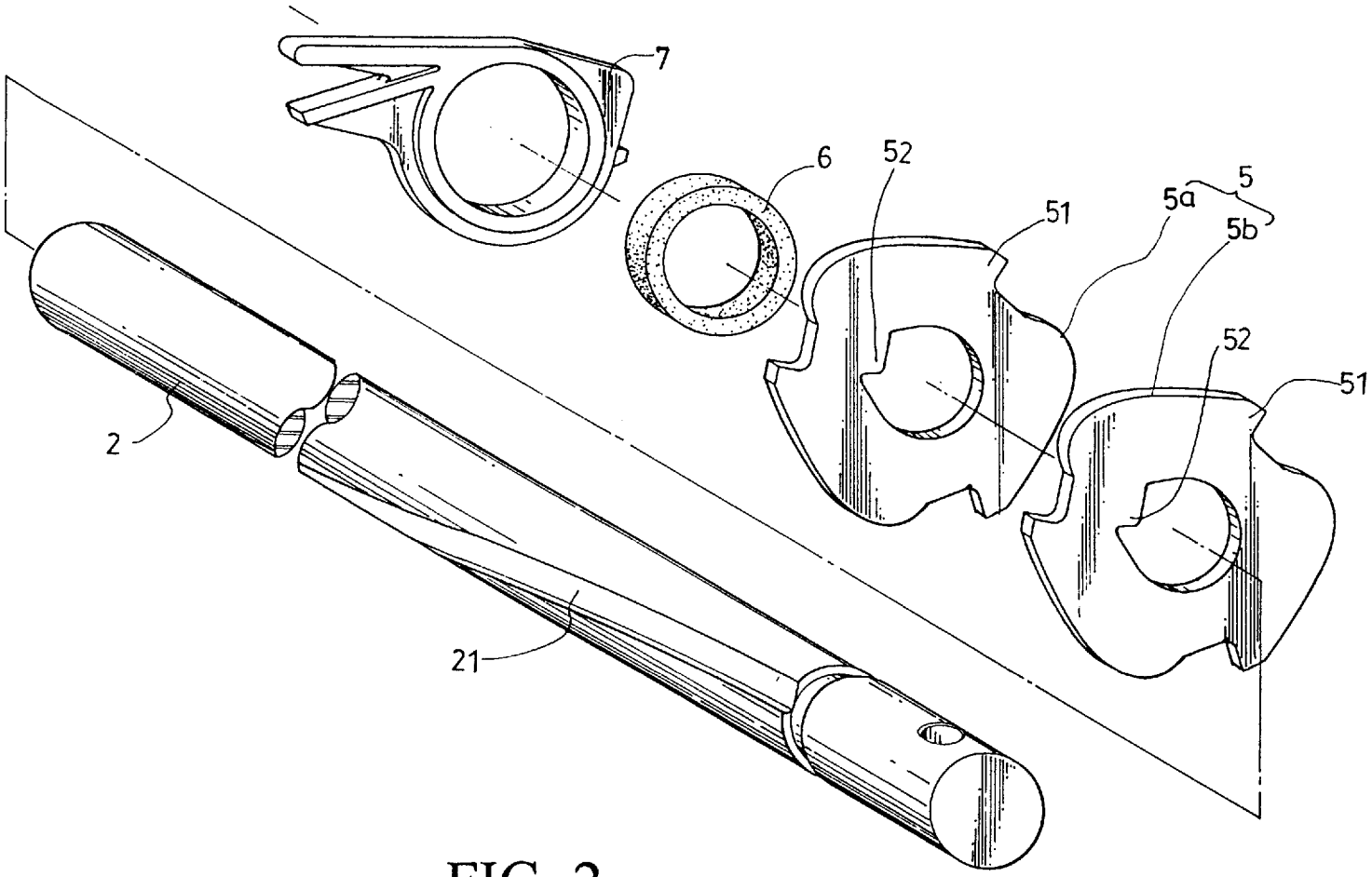
FIG. 2 is an exploded perspective view of the rotating shaft.
Figure 3:
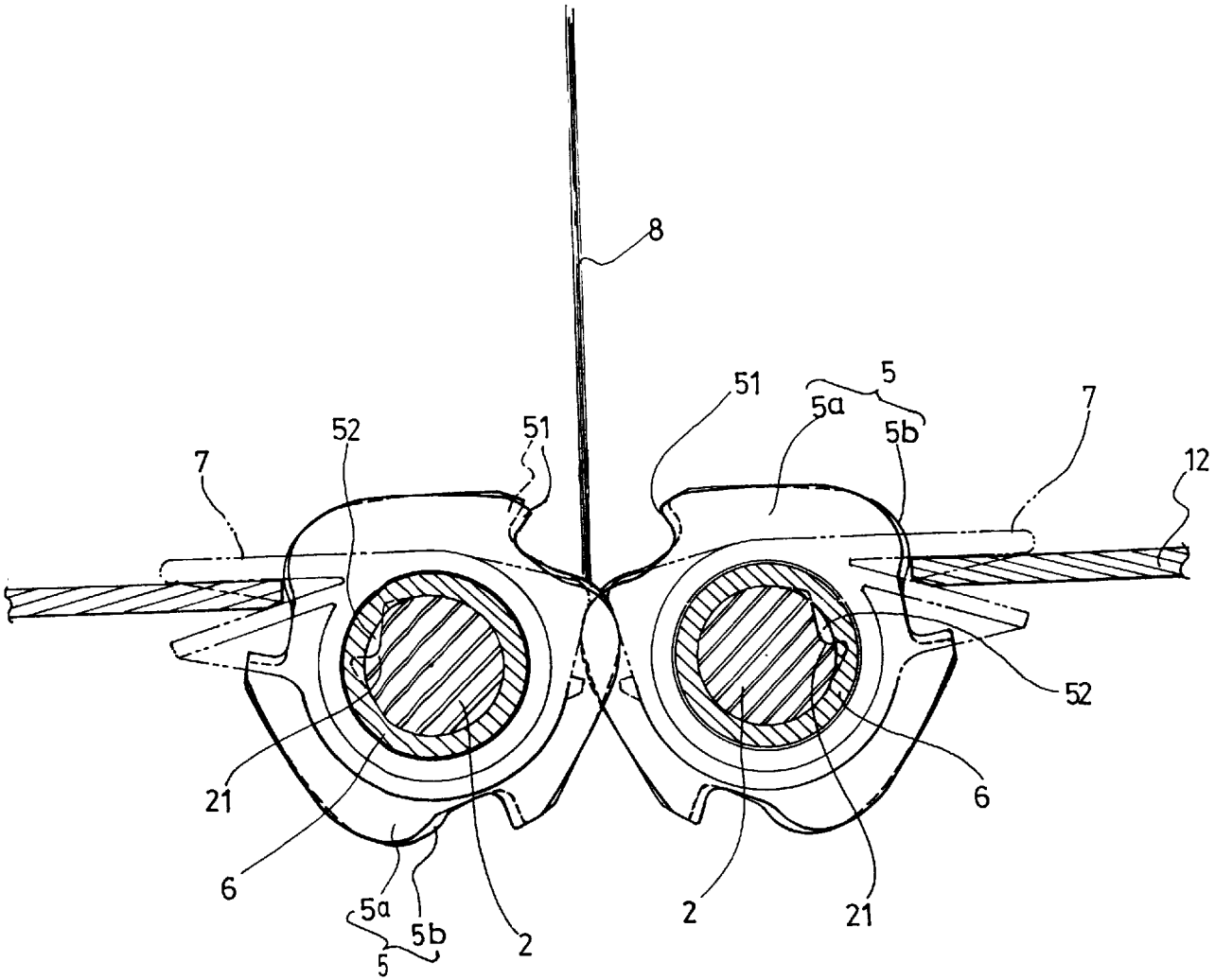
FIG. 3 is a schematic illustration view of the rotating shaft and the shredding blades.
Figure 4:
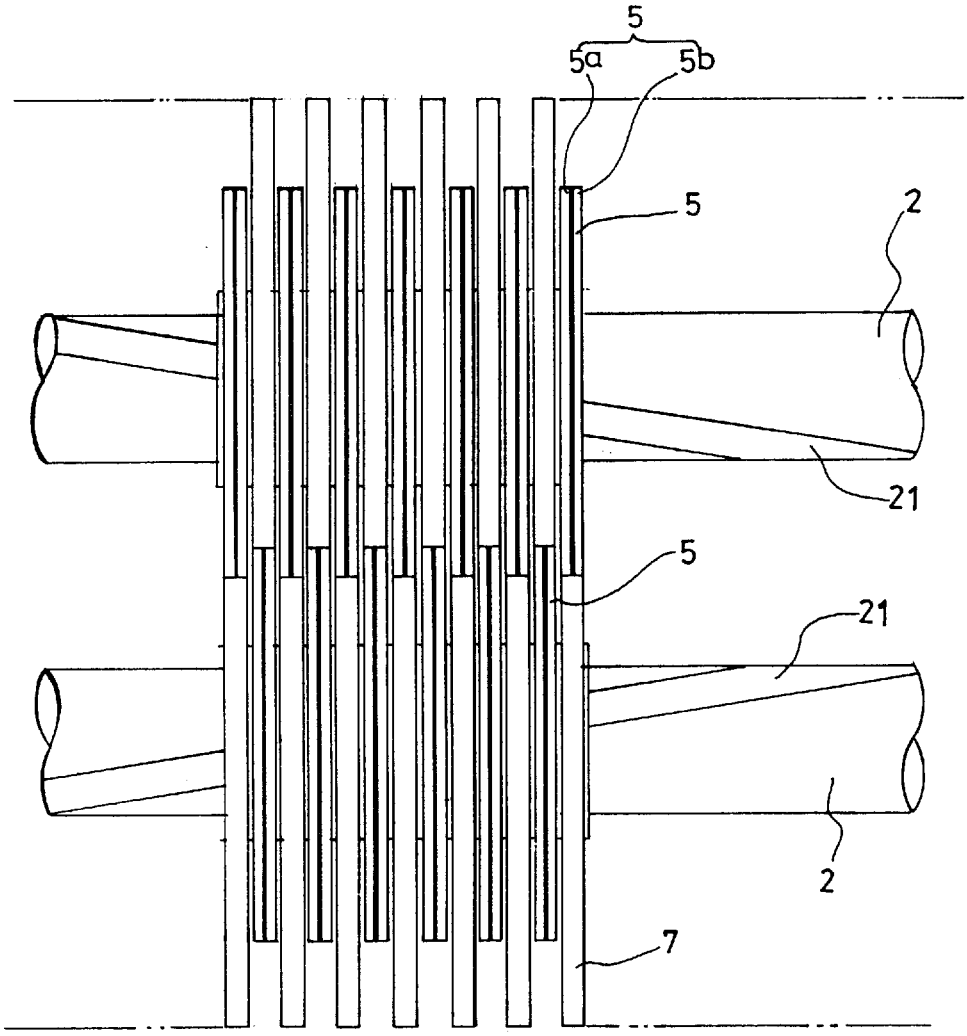
FIG. 4 is a top plan view of the rotating shaft and the shredding blades.

Referring to FIGS. 1 and 2, the desktop paper shredder made according to the present invention generally includes a housing 1 in which a pair of shafts 2 is rotationally mounted therein. The housing 1 is provided with an entrance 11 that is corresponding and aligned to shafts 2. A paper trash container 3 is removably disposed at the lower portion of the housing 1. Shafts 2 are driven by a driving device 4 and shafts 2 are meshed with each other such that their rotations are opposite with each other. Each shaft 2 is further provided with a spiral groove 21 in which a plurality set of shredding blades 5*a*, 5*b* are disposed therein. Each of the sets of shredding blades 5*a*, 5*b* is spaced with each other by means of a spacing collar 6 on which is provided a paper trash stopper 7. The external end portion of the paper trash stopper 7 is fixedly attached to the configuring tab 12 within the housing 1. The perimeter of the shredding blade 5 is further provided with a plurality of knifes 51. The shredding blade 5 is further provided with a projecting tab 52 that is rested into the spiral groove 21. Accordingly, the knife 51 of the shredding blade 5 is spirally arranged along the shaft 2. On the other end, as the projecting tab 52 of the shredding blade 5 has a difference therebetween, those knifes 51 of the shredding blade 5 are also alternatively intersected with each other, as shown in FIGS. 3 and 4. By this arrangement, the inserted paper sheet 8 can be effectively shredded by shredding blade 5 as the shafts 2 are rotated opposite to each other.

When the paper sheet 8 is inserted, a microswitch (not shown) will be triggered to actuate the driving device 4 to rotate. Then shafts 2 will be rotated opposite to each other. Since the shredding blades 5 on the two shafts 2 are overlapped and intersected with each other, as clearly shown in FIG. 4, the inserted paper can be effectively sheared into a plurality of elongate paper strips by the rotation of the knifes 51 of the shredding blade 5, as clearly shown in FIG. 3. Accordingly, the storing space occupied by the paper trash can be reduced. As a result, the storing space is relatively increased.

Besides, the stopper 7 arranged on the spacing collar 6 might effectively prevent the shredded paper strips being wound and ejected from the entrance 11. As a result, the paper trash strip 8 will be smoothly directed downward along the rotation of the shredding blades 5.

Besides, as the shredding blades 5 are spirally arranged onto the shafts 2, the power required to rotate shaft 2 is therefore reduced, while the shredding process can be smoothly performed. Furthermore, as the shredding blades 5 are arranged in pair and on the spiral groove 21 thereof, the knife 51 are alternatively arranged and intersected or overlapped at their tips. Consequently, the inserted paper sheet 8 can be effectively sheared by the tips of the knife 51.

As the housing 1 features a compact size that can be readily disposed on the desk. The user may conveniently use it to shred the paper sheet 8. The shredding job can be effectively done.

I claim:

1. A desktop paper shredder comprising:

a housing having an opening passing therethrough and a configuring tab within said housing, a pair of shafts mounted within said housing and aligned with said opening, said pair of shafts rotatable in opposite directions and each of said shafts having a spiral groove, a driving device connected to said pair of shafts, a first plurality of shredding blades fixed onto and rotatable with one of said pair of shafts, each of said first plurality of blades having a plurality of knives, a central opening, and a projecting tab extending from said central opening into said spiral groove of said shaft, a second plurality of shredding blades fixed onto and rotatable with the other of said pair of shafts, each of said second plurality of blades having a plurality of knives, a central opening, and a projecting tab extending from said central opening into said spiral groove of said shaft, said second plurality of shredding blades being interleaved with said first plurality of shredding blades, a plurality of spacing collars mounted on said shafts and separating two shredding blades, said spacing collars arranged on said shafts to provide the interleaving of said first plurality of shredding blades on one of said pair of shafts with said second plurality of shredding blades on the other of said pair of shafts, and a plurality of paper trash stoppers attached to said configuring tab, each of said paper trash stoppers fitting around a respective one of said plurality of spacing collars, whereby said plurality of paper trash stoppers prevent shredded paper from wrapping around said shafts and ejecting through said opening.

2. The desktop paper shredder according to claim 1, further comprising a container removably attached to said housing.

3. The desktop paper shredder according to claim 1, wherein said first plurality of shredding blades are spaced such that two shredding blades are paired together to abut each other and are adjacent on either side of the pairing to one of said first plurality of spacing collars, and said second plurality of shredding blades are spaced such that two shredding blades are paired together to abut each other and are adjacent on either side of the pairing to one of said second plurality of spacing collars.

4. The desktop paper shredder according to claim 3, wherein said plurality of knives of adjacent shredding blades are offset from each other.

5. The desktop paper shredder according to claim 1, wherein each of said plurality of paper trash stoppers includes an attachment member having a top arm and a bottom arm angled to each other such that said configuring tab fits between said two arms.

6. The desktop paper shredder according to claim 5, wherein each of said plurality of paper trash stoppers includes a counterweight portion located on a side of said shaft opposite to said attachment member.

7. The desktop paper shredder according to claim 5, wherein said top arm extends from said paper trash stopper along a line tangent to a top of said spacing collar.

8. The desktop paper shredder according to claim 5, wherein each of said plurality of paper trash stoppers includes a brace extending from said paper trash stopper up to a bottom surface of said bottom arm.

9. The desktop paper shredder according to claim 1, wherein each of said plurality of knives of said first plurality of shredding blades and said second shredding blades has a cross-section similar to surf in a direction perpendicular to the axis of rotation of said shafts.

* * * * *